US007559584B2

(12) United States Patent
Rebel et al.

(10) Patent No.: US 7,559,584 B2
(45) Date of Patent: Jul. 14, 2009

(54) DUAL-HOOK LOCKING ASSEMBLY

(75) Inventors: Jacob Rebel, Abbotsford (CA); Kai Zhang, Langley (CA); Hong Chen, Surrey (CA)

(73) Assignee: Vanguard Plastics Ltd., Surrey, BC (CA)

( * ) Notice: Subject to any disclaimer, the term of this patent is extended or adjusted under 35 U.S.C. 154(b) by 0 days.

(21) Appl. No.: 11/824,752

(22) Filed: Jul. 3, 2007

(65) Prior Publication Data

US 2007/0259551 A1 Nov. 8, 2007

(51) Int. Cl.
*E05C 19/10* (2006.01)

(52) U.S. Cl. ..... 292/25; 292/26

(58) Field of Classification Search ..... 292/25, 292/26, 39, 51, 112, DIG. 46
See application file for complete search history.

(56) References Cited

U.S. PATENT DOCUMENTS

| | | | | |
|---|---|---|---|---|
| 1,320,444 | A * | 11/1919 | Buczynski | 70/97 |
| 1,549,505 | A * | 8/1925 | Rasmussen | 292/25 |
| 5,820,170 | A | 10/1998 | Clancy | |
| 5,951,068 | A * | 9/1999 | Strong et al. | 292/39 |
| 6,502,435 | B2 | 1/2003 | Watts et al. | |
| 6,672,632 | B1 | 1/2004 | Speed et al. | |
| 6,776,441 | B2 * | 8/2004 | Liu | 292/26 |
| 7,040,671 | B2 * | 5/2006 | Su et al. | 292/24 |
| 2004/0245784 | A1 * | 12/2004 | Tsai | 292/51 |
| 2006/0071478 | A1 * | 4/2006 | Denys | 292/26 |

* cited by examiner

*Primary Examiner*—Gary Estremsky
(74) *Attorney, Agent, or Firm*—Frederick Kaufman Inc.

(57) ABSTRACT

A dual-hook locking assembly mounted in a casing subassembly is actuated from outside of the latter by a handle which causes a locking subassembly to operate between an unlocked and a locked position. By rotating the driving handle, a gearing subassembly including a pair of meshed segmental gears drives the locking subassembly between the aforementioned positions. The gearing subassembly and the locking subassembly are directly interconnected. An adjusting subassembly is used for positioning the locking subassembly with respect to a strike plate of a door. The adjusting subassembly comprises several guiding plates. The latter and the gearing subassembly have a common center of rotation.

5 Claims, 8 Drawing Sheets

DUAL-HOOK LOCKING ASSEMBLY

I. BACKGROUND OF THE INVENTION

1. Technical Field

The present invention relates in general to locking assemblies and, in particular, to a dual-hook locking assembly.

2. Description of the Prior Art

To keep pace with continuous advances in home building and in order to comply with the requirements to enhance the security of existing homes and flats, the need to develop new, improved locking assemblies became a pressing reality. Consequently, attempts have been made to develop compact and reliable dual-hook assemblies, which, in comparison with one hook locking assemblies, provide enhanced security. An example of such an attempt is U.S. Pat. No. 6,776,441, granted on Aug. 17, 2004 to Liu for a "Lock Assembly with Two Hook Devices". This patent comprises a casing, a pivotable member rotatably mounted in the casing, two linking rods, each having a first and a second end, the first end being rotatably connected to the pivotable member, and two hook devices, each including a first hook member and a second hook member. Each second hook member is pivotally mounted in the casing. The second end of each linking rod is pivotally connected to an associated second hook member. Each hook member further includes a hooked second end that is passable through an associated opening of the casing. As can be seen, the described hook assembly uses between the driving component/pivotable member/and the driven component/second hooked end of each first hook member/a transmission structure consisting of links rods, and each second hook member is as pivotable member rotatably mounted in the casing. Hence, this assembly lacks compactness, while the use of an interposed transmission negatively affects the assembly's reliability. Another example is U.S. Pat. No. 7,040,671, granted on May 9, 2006 to Liu for a "Lock Assembly with Two Hook Devices". This patent discloses a lock assembly including a casing, two pivotable members rotatably mounted in the casing and meshed with each other, two linking rods, and two hook devices, each including a hook member and a rocker arm that is pivotally mounted in the casing. Each hook member has a first end pivotally connected to an associated rocker arm and a hooked second end that is passable through an associated one of two openings of the casing. When either pivotable member is rotated, each rocker arm and each hook member are actuated such that the hooked second end of each hook member is moved between a retracted position in the casing and a locking position out of the casing. As can be inferred from the above description of U.S. Pat. No. 7,040,671, the components of the latter are basically common, except two pivotable members rotatably mounted in the casing and meshed with each other, with those described in U.S. Pat. No. 6,776,441. As a corollary of this similarity, it is obvious that the shortcomings of the latter patent, as stated above, also apply to U.S. Pat. No. 7,040,671.

II. SUMMARY OF THE INVENTION

Taking in account the mentioned drawbacks, in the designing of an improved dual-hook locking assembly according to the present invention, the main aimed objective has been to reduce to a minimum the number of components of the locking assembly, such as articulated links and those components which require pivoting supports.

Broadly stated, the dual-hook locking assembly according to the present invention comprises a subassembly for housing wherein are mounted: a gearing subassembly for operating, a subassembly for locking, operated between a locked position and an unlocked position by the gearing subassembly for operating, and a subassembly for adjusting subassembly for locking in a convenient position with respect to a strike plate.

The subassembly for housing comprises an elongated housing and a closing plate, the former and the latter being assembled together.

The gearing subassembly for operating includes a pair of pivoting bodies, each one of the latter incorporating a segmental gear. An actuation of one of the pivoting bodies transmits a rotation via its segmental gear to the other segmental gear, the former meshing with the latter. Each one the pivoting bodies incorporate as well a tail element situated in a zone adjacent to the segmental gear and provided with a perpendicular opening for insertion of a connecting feature.

The subassembly for locking comprises a pair of hook mechanisms, an upper and lower structurally identical hook mechanisms. Each of the latter has an outwardly extending hook section, a middle section and an inwardly extending connecting section extending towards the transversal axis of symmetry of the subassembly for housing. The inwardly extending connecting section includes a contacting lobe and a hole, located in a zone adjacent to the latter, the latter being positioned for coinciding with the perpendicular opening for insertion, through which the connection feature is inserted. Thus, a direct pivoting interconnection between each gearing subassembly for operating, respectively each tail element of each pivoting body, and the subassembly for locking, is established. Each of the latter has an aperture in its middle section penetrated by a pin protruding outwardly beyond the subassembly for locking as adjusting butts.

At least one tension springy element for connecting the hook mechanisms via an anchor-cam wall is used. The latter is coplanar with the transversal axis of symmetry and is disposed perpendicularly to a central front wall of the elongated housing. At least one helical tension spring for connecting the hook mechanisms develops a return force from its extended position when the hook mechanisms are in their latching position, and resiliently keep the hook mechanisms when they are in retracted, unlocked position. The subassembly for adjusting the subassembly for locking in a convenient position with respect to a strike plate includes two pairs of guiding plates, each pair of the latter being able to turn with its inwardly extending ends around one of the pivoting bodies and interact with one of the hook mechanisms, while its outwardly extending ends are associated with an adjusting bolt-nut.

In one aspect of this invention, for anti-slam protection the elongated housing is provided with two stop lugs (an upper and a lower), struck from a lateral main wall of the elongated housing, inclined with respect to the transversal axis of symmetry and disposed somewhat closer to a back wall. One stop lug is situated in the proximity of a top wall, while the other one—in proximity of a bottom wall. The pair of hook mechanisms are provided with middle sections. During a slamming of a door the middle sections press against and are stopped by the stop lugs; one of the stop lugs, the upper one, imparts essentially a translation combined with rotation resulting in a force directed towards the transversal axis of symmetry to one of the hook mechanisms (the upper one), and/or another one of the stop lugs (the lower one) imparts essentially a translation combined with rotation resulting in a force directed towards the transversal axis of symmetry to one of the hook mechanisms (the lower one).

III. BRIEF DESCRIPTION OF THE DRAWINGS

Although the characteristic features of the invention will be particularly pointed out in the claims, the invention itself and the manner in which it may be made and used may be better understood by referring to the following description and accompanying drawings. Like reference numerals refer to like parts throughout the several views of the drawings in which:

IV. DESCRIPTION OF THE PREFERRED EMBODIMENT

Figure 1:
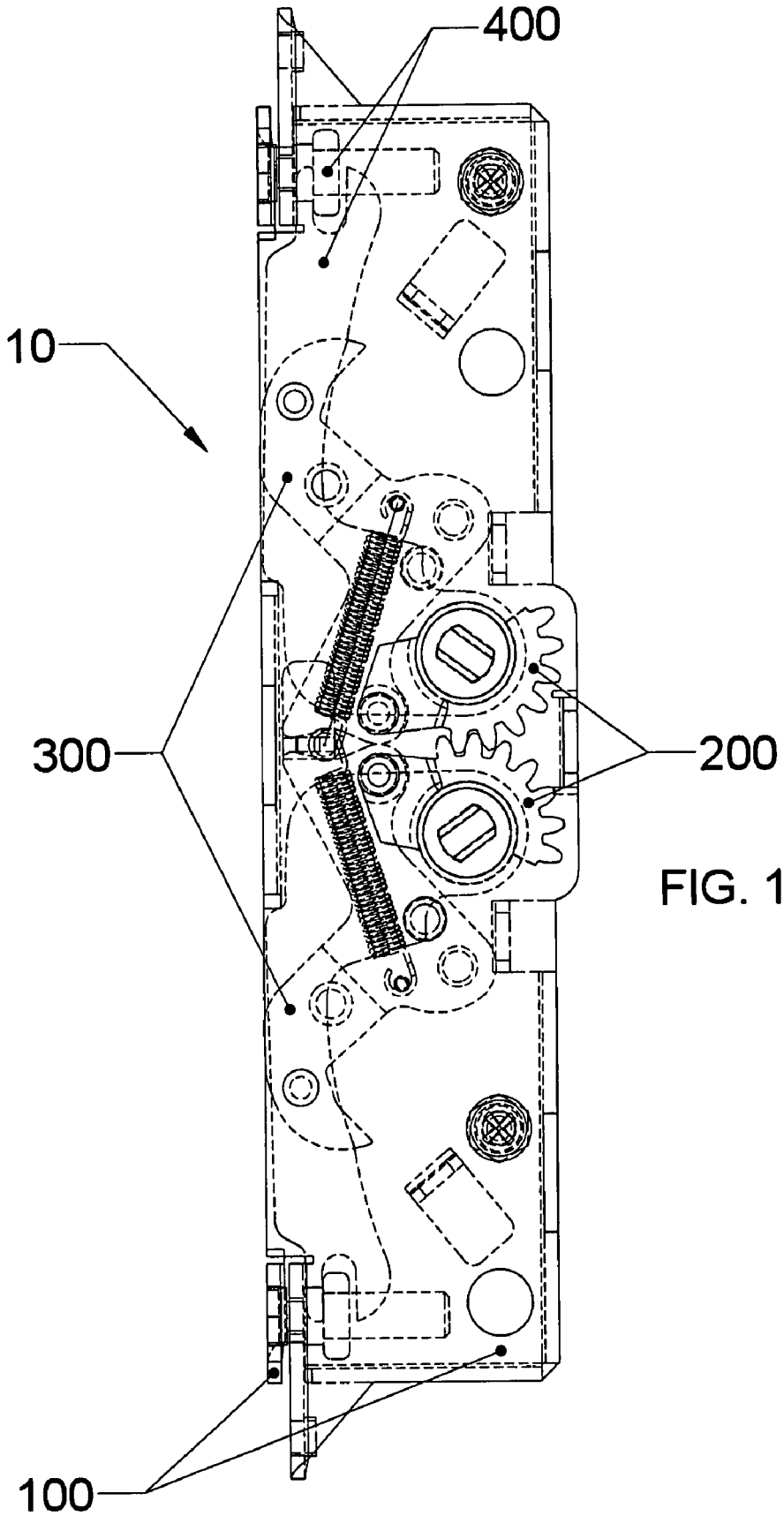
FIG. 1 is a side elevation view of the present invention, illustrating the dual-hook locking assembly in an unlocked state.
Figure 2:
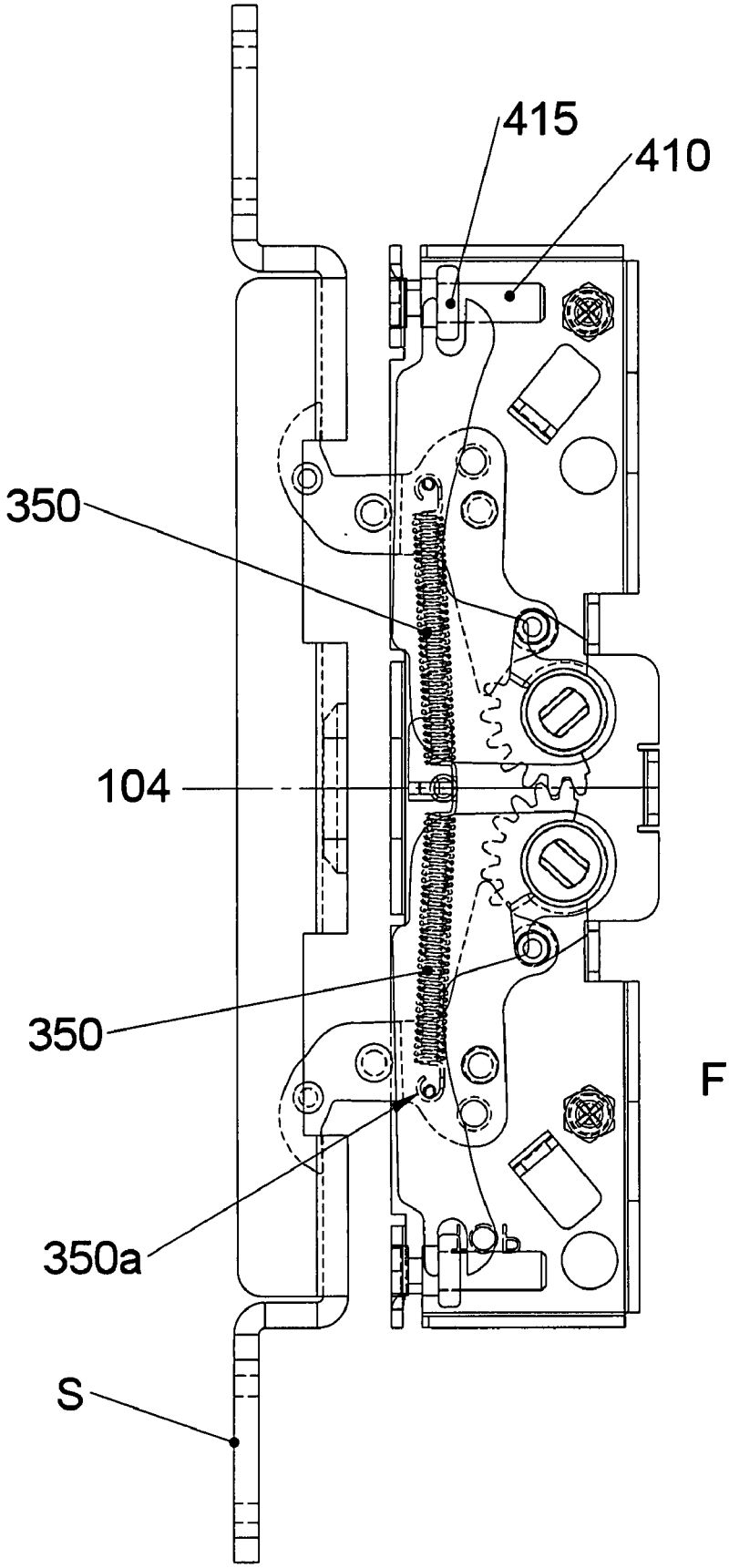
FIG. 2 is a view similar to FIG. 1, wherein the dual-hook locking assembly is in a locked state.
Figure 3:
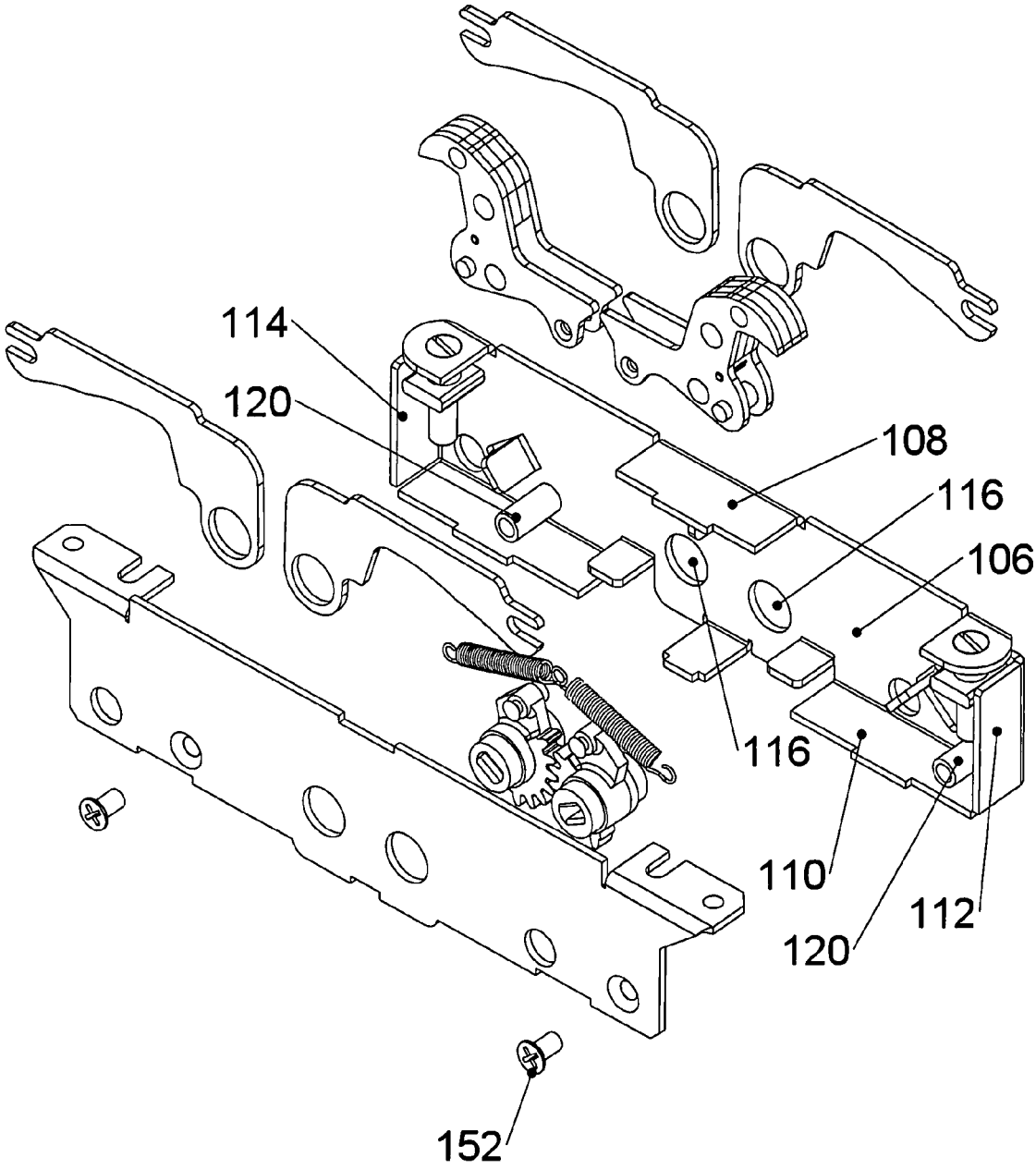
FIG. 3 shows an exploded perspective view of the dual-hook locking assembly in accordance with the present invention.
Figure 4:
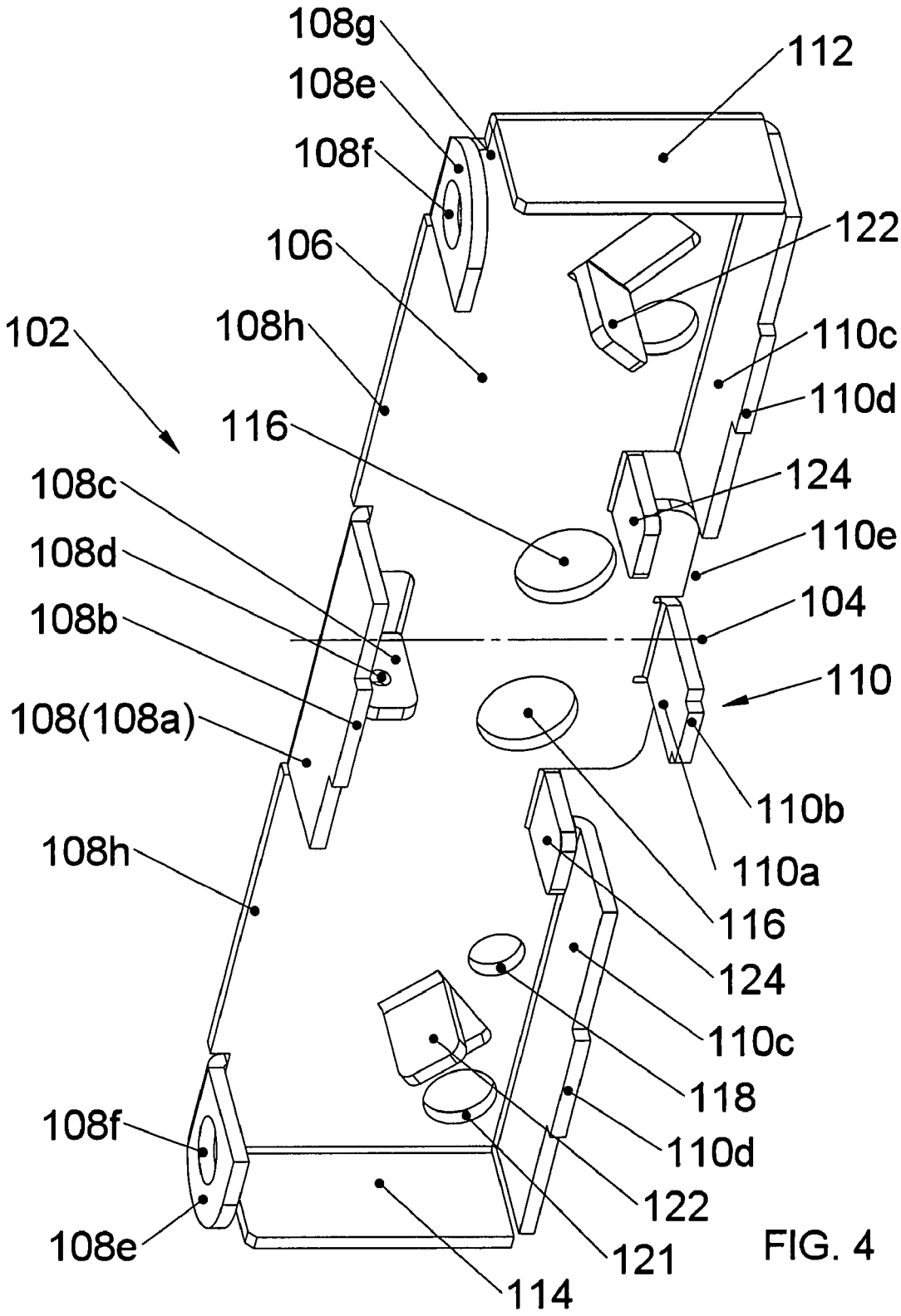
FIG. 4 shows a perspective view of the elongated housing, which constitutes the main component of the casing subassembly.
Figure 5:
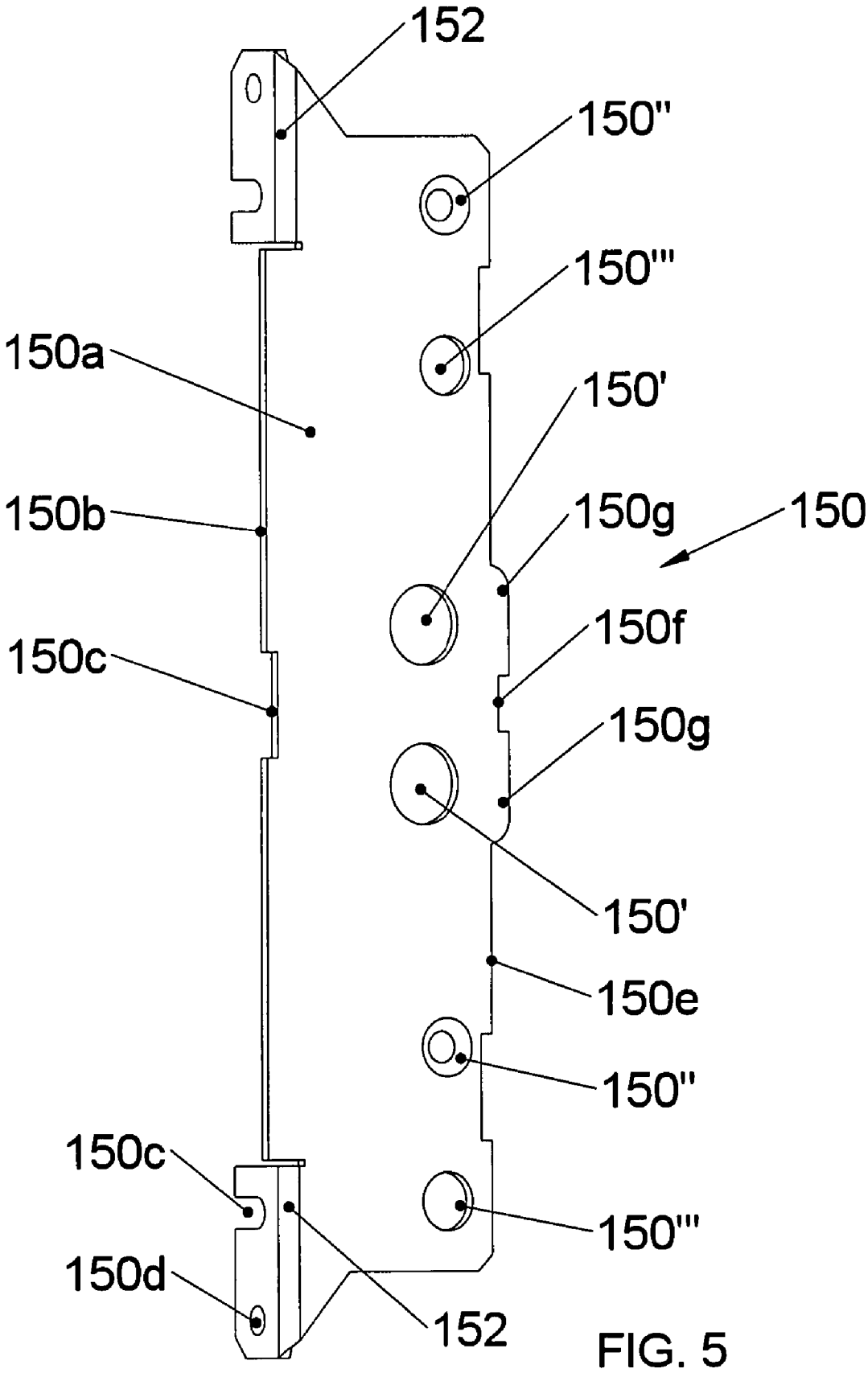
FIG. 5 shows a perspective view of the closing plate, the other component of the casing subassembly.
Figure 6:
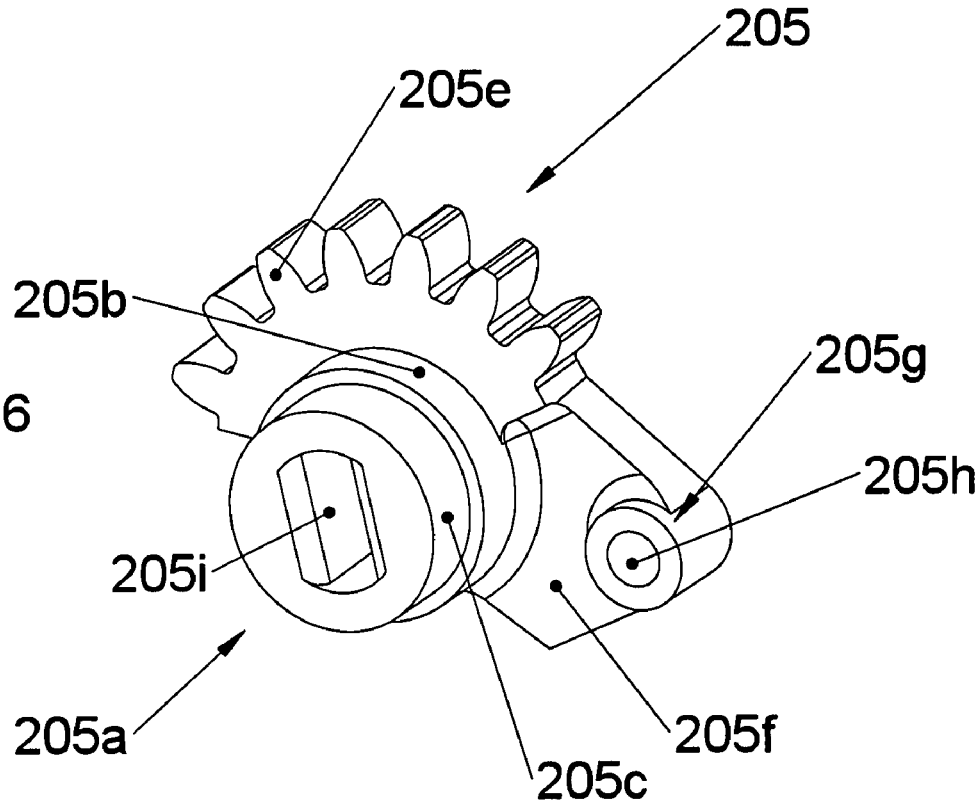
FIG. 6 is a perspective of an upper pivoting body, viewed from the front.
Figure 7:
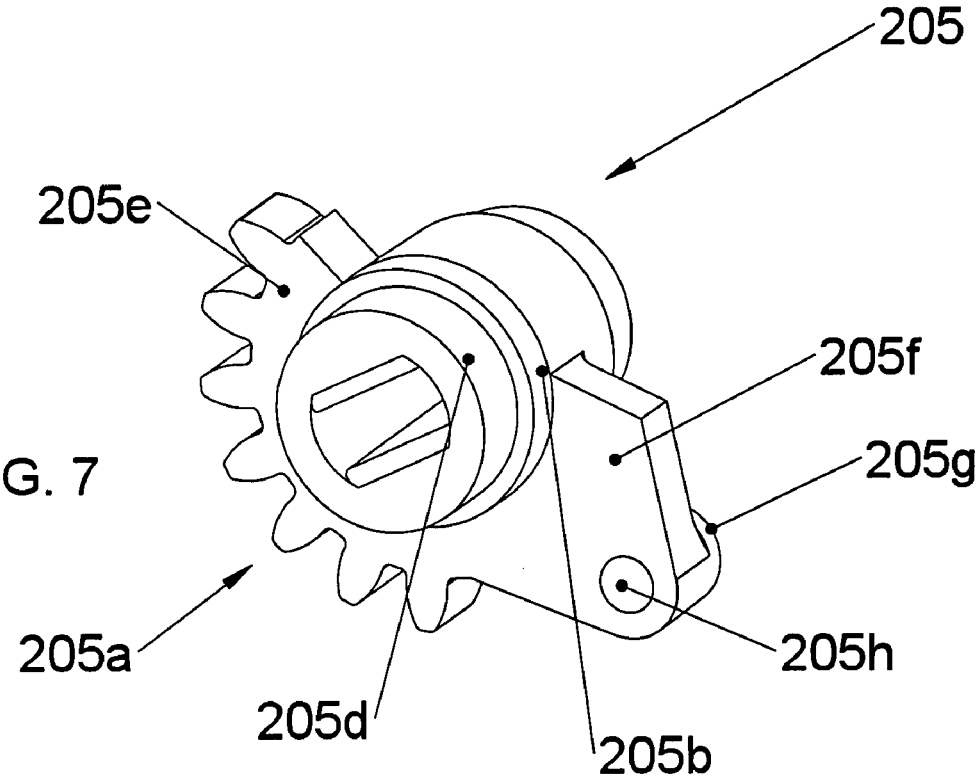
FIG. 7 is a perspective of the upper pivoting body of FIG. 6, viewed from the back.
Figure 8:
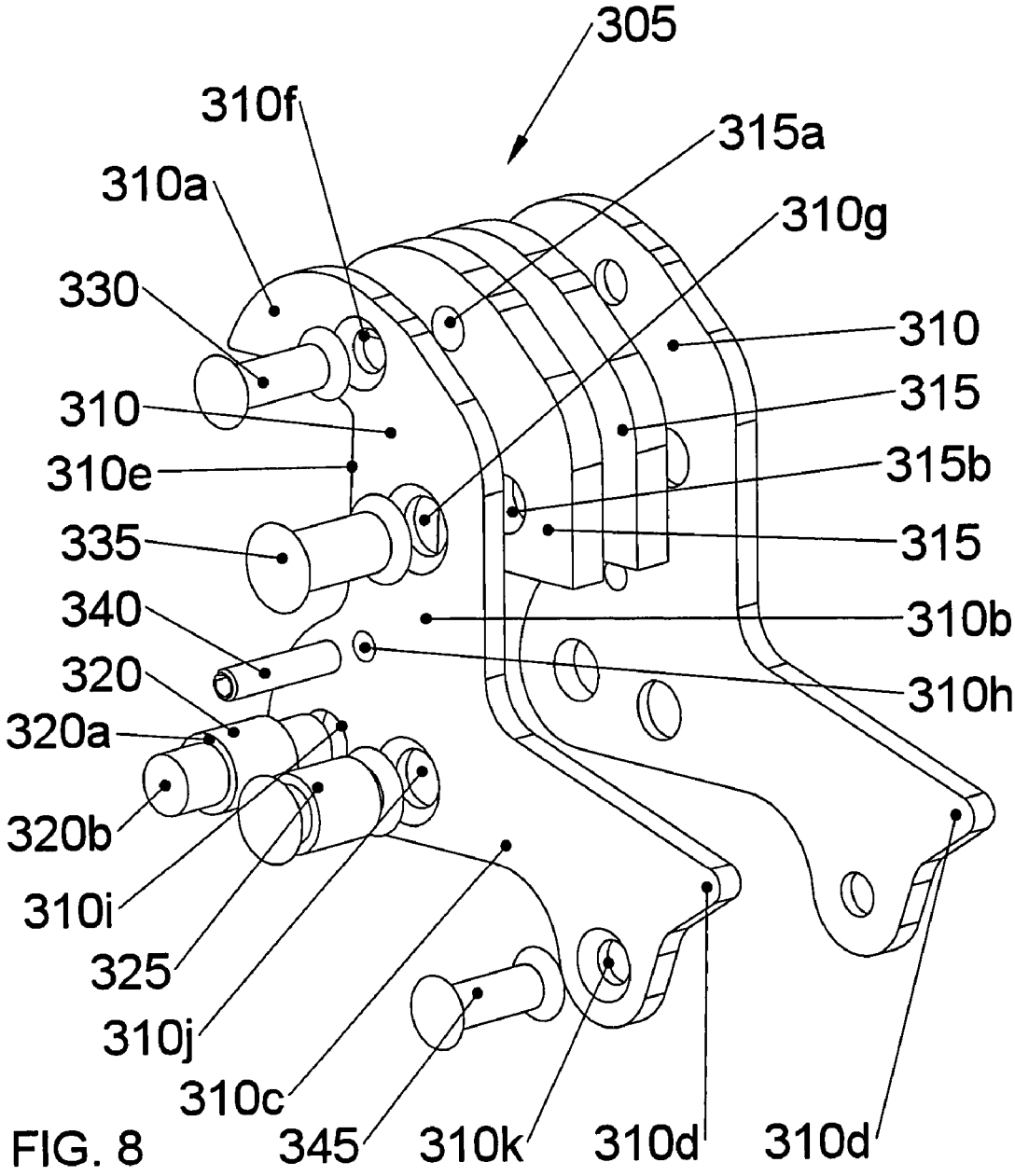
FIG. 8 shows an exploded perspective view of a hook mechanism.
Figure 9:
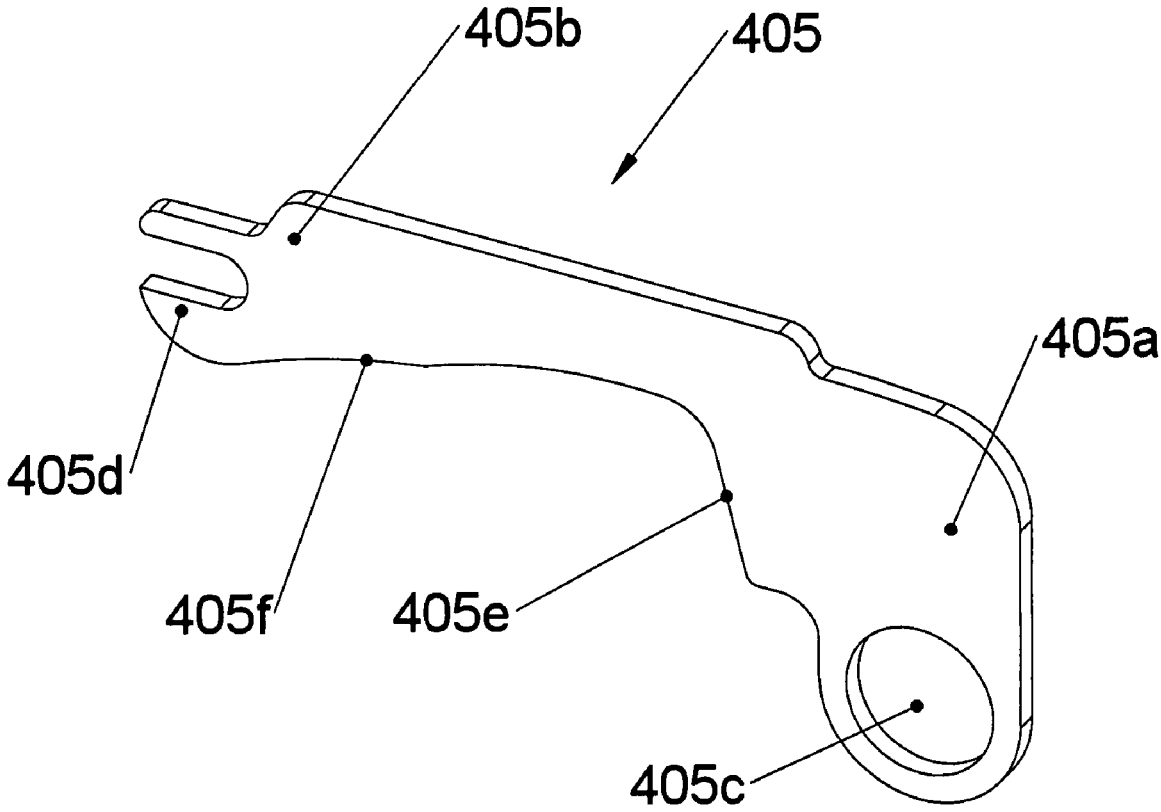
FIG. 9 is a perspective view of one of the guiding plates of the adjusting subassembly.

As can be seen from the accompanying drawings, a dual-hook locking assembly according to the present invention is generally identified by reference number 10.

It is to be agreed, that terms such as "vertical", "horizontal", "upper", "lower", "inward", "upward", "downward", "front", "back", "lateral", "top", "bottom" are conventionally employed in the present specification with reference to a usual position in a door in which locking assembly 10 will be generally used.

Dual-hook locking assembly 10 comprises:

a casing subassembly 100;

a gearing subassembly 200;

a locking subassembly 300; and an adjusting subassembly 400, gearing, locking and adjusting subassemblies 200, 300 and 400 are all located in casing subassembly 100 and are generally used as follows:

casing subassembly 100 for housing all other aforementioned subassemblies;

gearing subassembly 200 for operating locking subassembly 300 between a locked position and an unlocked position; and adjusting subassembly 400 for conveniently positioning the latter with respect to a strike plate S used for interconnecting with dual-hook locking subassembly 10.

Casing subassembly 100 comprises an elongated housing 102 and a closing plate 150. The former and the latter are usually formed by stamping and assembled together by threaded elements or by snapping. It is obvious that other known manufacturing methods could substitute the stamping method of fabrication.

Elongated housing 102 is basically defined by a transversal axis of symmetry 104 and includes a lateral main wall 106 which extends into front 108 and back 110 walls and into top 112 and bottom 114 walls.

Lateral main wall 106 incorporates two guiding openings 116, identical, vertically aligned and equally spaced from transversal axis of symmetry 104. Lateral main wall 106 further incorporates two attachment openings 118, identical, vertically aligned and disposed asymmetrically with respect to transversal axis of symmetry 104. One of the two attachment openings 118 is somewhat spaced from top wall 112, while the other one is relatively closer to bottom wall 114 of lateral main wall 106. Two threaded blind sleeves 120, disposed coaxially with attachment openings 118, extend horizontally and inwardly from lateral main wall 106, to which they are permanently secured. Two mounting openings 121 used for attachment to a window or door profile (both not shown), one being closer to top wall 112 while the other one relatively spaced from bottom wall 114, alternate with the two threaded blind sleeves 120.

Two stop lugs 122 (an upper and a lower), struck from lateral main wall 106, are inclined with respect to transversal axis of symmetry 104 and disposed somewhat closer to back wall 110; one stop lug 122 being situated in the proximity of top wall 112, while the other one—in the proximity of bottom wall 114.

Two engaging lugs 124, bent from lateral main wall 106, are perpendicularly disposed with respect to transversal axis of symmetry 104, at each side of and proximate to the latter. The two engaging lugs 124 are somewhat inwardly retracted from a vertical plane passing through back wall 110.

Front wall 108 comprises a central front wall 108*a* that perpendicularly and centrally projects from the front of lateral main wall 106, from which it is bent. The former is also perpendicular to transversal axis of symmetry 104. A central rectangular protrusion 108*b*, relatively much smaller than central front wall 108*a*, the former and the latter being coplanar, extends from the latter. An anchor-cam wall 108*c*, coplanar with transversal axis of symmetry 104, is disposed perpendicularly to central front wall 108*a* (a gap, not shown, being established between anchor-cam wall 108*c* and the latter) and is provided with an aperture 108*d*. Furthermore, front wall 108 comprises, starting from each of its longitudinal extremities, a pair of front wall ends 108*e*, each of the latter being provided with a hole 108*f*. Front wall 108 includes between central front wall 108*a* and each front wall end 108*e* an open space 108*h*. Between each front wall end 108*e* and top 112 and bottom 114 walls, an interstice 108*g* is provided.

Back wall 110 comprises a central back wall 110*a* that perpendicularly and centrally projects out of the back of lateral main wall 106, from which it is bent. The former is also perpendicular to transversal axis of symmetry 104. A central rectangular extension 110*b*, relatively much smaller than central back wall 110*a*/the former and the latter being coplanar/, extends out from the latter.

Furthermore, back wall 110 includes, starting from each of its longitudinal extremities, a pair of back wall ends 110*c* located in the same vertical plane. Each back wall end 110*c* is provided with a central rectangular projection 110*d*. Back wall 110 further comprises between central back wall 110*a* and each back wall end 110*c* an empty space 110*e*. Central back wall 110*a* and back wall ends 110*c* are parallel, the former being somewhat protruded with respect to the latter.

Closing plate 150 of casing subassembly 100 includes a lateral base wall 150*a* that extends into a pair of perpendicularly bent and longitudinally opposite face walls 152.

Lateral base wall 150*a* is provided with a pair of first openings 150' coaxial and commensurate with two guiding openings 116, with a pair of chamfered openings 150" coaxial and commensurate with two threaded blind sleeves 120 and their attachment openings 118 and with a pair of second openings 150'" coaxial and commensurate with two mounting openings 121.

Furthermore, lateral base wall 150*a* is delimited by a frontal margin 150*b*, centrally provided with an indentation 150*c*, shaped and sized to enable an engagement with central rectangular protrusion 108*b*/when elongated housing 102 and closing plate 150 are assembled together/.

Perpendicularly bent and longitudinally opposite face walls 152 are somewhat retracted from a vertical plane which incorporates frontal margin 150*b* as to enable their insertion into interstices 108*g*, beneath the pair of front wall ends 108*e*/when elongated housing 102 and closing plate 150 are assembled together/.

Each perpendicularly bent and longitudinally opposite face wall 152 includes a guiding slot 150*c* corresponding to hole 108*f* and extends upwardly beyond top wall 112 and downwardly beyond bottom 114 wall, wherein a circular perforation 150*d* is made.

Lateral base wall 150*a* is delimited as well by a rear margin 150*e* which incorporates a central indented passage 150*f*, shaped and sized to enable the insertion of central rectangular extension 110*b*. Central indented passage 150*f* is flanked by a pair of protrusions 150*g* extending past rear margin 150*e*. Protrusions 150*g* match empty spaces 110*e* located between central back wall 110*a* and each back wall end 110*c*.

Complementarily to the above features with which a centering between elongated housing 102 and closing plate 150 is achieved, a fastening of the former and latter with screws 152 passing through chamfered openings 150" and tightened into two threaded blind sleeves 120 is used. Alternatively, snapping can be used for fastening of elongated housing 102 and closing plate 150.

Uses of the different features of casing subassembly 100, not described above, are discussed in detail later in the present disclosure.

In more detail in terms of structure, gearing subassembly 200 includes a pair of pivoting bodies 205 (an upper and a lower) enabled to rotate in two guiding openings 116 provided in lateral main wall 106 of elongated housing 102 and in the pair of first openings 150' provided in lateral base wall 150*a* of closing plate 150. A pivoting body 205 is structurally a unitary component and includes a stepped cylindrical shaft 205*a* having a median section 205*b* with a relatively larger diameter and, as well, a front section 205*c* and a back section 205*d*, both with a relatively lesser diameter. The front section 205*c* and back section 205*d* engage with a sliding fit two guiding openings 116 and, respectively, the pair of first openings 150'. A segmental gear 205*e* extends out from median section 205*b* of each stepped cylindrical shaft 205*a*. Two segmental gears 205*e* (an upper and a lower) mesh together, so that a rotation of either one of pivoting bodies 205 transmits a rotation to the other. A thickness of segmental gear is somewhat less than a length of median section 205*b*.

A tail element 205*f*, relatively thinner than segmental gear 205*e* and situated in a zone adjacent to the latter, extends from median section 205*b*. A cylindrical element 205*g* projects perpendicularly out from an extremity of tail element 205*f* and is provided with a perpendicular opening 205*h* that continues throughout the latter.

In each stepped cylindrical shaft 205*a* a longitudinal slot 205*i* is formed. The latter is adapted to be actuated by a handle (not shown).

Alternatively to the foregoing description of the pair of pivoting bodies 205 (an upper and a lower), wherein due to the shape and position of tail element 205*f* with respect to segmental gear 205*e*, the upper pivoting body differs from the lower pivoting body, one being the mirror image of the other one, a conveniently modified tail element 205*f* can render the pivoting bodies 205 identical.

Locking subassembly 300 includes an upper and lower hook mechanism 305, each of which comprising a pair of long external hook plates 310 and a pair of superimposed short internal hook plates 315, the latter being interposed between the former. Upper and lower hook mechanisms 305 being structurally identical are further called hook mechanisms 305.

A long external hook plate 310 incorporates an outwardly extending hook section 310*a*, a middle section 310*b* and an inwardly extending connecting section 310*c* extending towards transversal axis of symmetry 104 and including a contacting lobe 310*d*. Between outwardly extending hook section 310*a* and middle section 310*b* a recessed zone 310*e* is formed.

The pair of superimposed short internal hook plates 315 is so shaped and sized as to be sandwiched between and geometrically conform to outwardly extending hook sections 310*a* and to a part of middle sections 310*b* of the pair of long external hook plates 310.

Each long external plate 310 has, starting from outwardly extending hook section 310*a* downwardly, a first chamfered hole 310*f*, a second chamfered hole 310*g*, a relatively reduced diameter hole 310*h*, a conventional hole 310*i*, and then, from there, laterally towards contacting lobe 310*d*, a fourth chamfered hole 310*j* and a fifth chamfered hole 310*k*.

Each short internal hook plate 315 incorporates two corresponding holes 315*a* and 315*b* equal in size and coaxial with first and second chamfered holes 310*f* and 310*g*.

A stepped pin 320 is placed between long external plates 310 so that its shoulders abut against the latter, while its extremities pass through long external plates 310, namely opposed conventional holes 310*i*, and protrude outwardly beyond the latter in the form of adjusting butts 320*b*. Conveniently, a cylindrical pin can substitute stepped pin 320. The length of cylindrical pins is so chosen as to enable their ends to freely slide on opposed internal walls of casing subassembly 100.

A stepped rivet 325 is also placed between long external plates 310 so that its shoulders, when it is riveted, keep spaced the foregoing plates at the same distance as when the pair of superimposed short internal hook plates 315 is interposed between the pair of long external hook plates 310.

A first countersunk-head rivet 330, which passes through first chamfered holes 310*f* and corresponding holes 315*a*, attaches together the pair of long external hook plates 310 between which is sandwiched the pair of superimposed short internal hook plates 315. Furthermore, a second countersunk-head rivet 335, which passes through second chamfered holes 310*g* and corresponding holes 315*b*, attaches also together the pair of long external hook plates 310 and the pair of superimposed short internal hook plates 315.

An expandable split cylinder 340 is press fit into opposed relatively reduced diameter holes 310*h* provided in the pair of long external hook plates 310. Alternatively, a stepped pin can be conveniently used.

A connecting pin 345 for insertion through cylindrical element 205*g* that projects perpendicularly out of an extremity of tail element 205*f*, respectively through its perpendicular opening 205*h* which extends throughout the latter, and throughout the pair of long external hook plates 310, respectively through their fifth chamfered holes 310*k*, is used. Thus, a direct pivotable linkage/without the use of intermediary links/is established between gearing subassembly 200 and locking subassembly 300.

Optionally, to the above described hook mechanisms 305, a variant comprising a single unitary component substituting for a pair of long external hook plates 310 and a pair of superimposed short internal hook plates 315, the latter being interposed between the former, can be used.

A helical tension spring 350 terminating at each end with a spring hook 350*a*/made of one or more bent coil(s)/is used separately for upper and for lower hook mechanisms 305 of locking subassembly 300. Thus, one spring hook 350*a* is connected to anchor-cam wall 108*c* belonging to elongated housing 102, specifically via aperture 108*d* of the former, while an opposite spring hook 350*a* is connected to expandable split cylinder 340 comprised in upper and lower hook mechanisms 305.

Alternatively, instead of the use of a helical tension spring 350, separately for upper and for lower hook mechanisms 305 of locking subassembly 300, a variant using a single helical tension spring connecting expandable split cylinders 340 comprised in upper and lower hook mechanisms 305 and passing through the gap formed between central front wall 108*a* and anchor-cam wall 108*c* can be used.

Instead of helical tension spring 350, use can be made of another conveniently chosen biasing element.

Adjusting subassembly 400 comprises:

two pairs of guiding plates 405, one pair of the latter being used to interact with upper hook mechanism 305, while the other pair-with lower hook mechanism 305; and a pair of adjusting bolt-nuts: 410 (bolt) and 415 (nut).

Each pivoting body 205 of gearing subassembly 200 together with its associated hook mechanism 305 are flanked by a pair of guiding plates 405 in contact with lateral main wall 106 of elongated housing 102 and, respectively, with lateral base wall 150*a* of closing plate 150.

A guiding plate 405 includes an inwardly extending end 405*a* (extending towards the transversal axis of symmetry 104) and an outwardly extending end 405*b* (away from transversal axis of symmetry 104). Inwardly extending end 405*a* is provided with a centering circular aperture 405*c*, the latter being concentric and commensurate with guiding opening 116 of lateral main wall 106 and, respectively, with first openings 150' provided in lateral base wall 150*a* of closing plate 150. Outwardly extending end 405*b* includes a bifurcated section 405*d*.

Each guiding plate 405 is provided between inwardly extending end 405*a* and outwardly extending end 405*b* with a slope edge 405*e* followed by a cam edge 405*f*.

Each adjusting bolt 410 passes through hole 108*f* provided in a front wall end 108*e* of front wall 108 and then through guiding slot 150*c* provided in an opposite face wall 152 of closing plate 150. Adjusting bolt 410 is threaded into nut 415. The latter is easy-fit into bifurcated sections 405*d* of a pair of parallel-opposite guiding plates 405.

Operation of Dual-Hook Locking Assembly 10

Gearing subassembly 200 operates locking assembly 300 in response to a rotation of a tail element of a driving handle (both not labeled) inserted into longitudinal slot 205*i* of either one of the pair of pivoting bodies 205.

Due to the fact that gearing subassembly 200 comprises a pair of pivoting bodies 205, each one of the latter incorporating a segmental gear 205*e*, an actuation of one the pivoting bodies 205*f* transmits the rotation via its segmental gear 205*e* to the other segmental gear 205*e*, the former meshing with the latter. Pivoting bodies 205 synchronously rotating cause a rotation accompanied by a translation of hook mechanisms 305 (the upper and the lower), with which they are respectively associated, between a locked position and an unlocked position.

In order to positionally adjust hook mechanisms 305 to obtain an appropriate locking, the latter are conveniently rotated around pivoting bodies 205. To this end, the pair of adjusting bolt-nut assemblies: 410 (bolt) and 415 (nut) are so positioned that during the locking operation a continuous engagement between stepped pin 320 and cam edge 405*f* occurs, so that the extreme position of outwardly extending hook sections 310*a* is limited.

Helical tension springs 350 develop a return force from their extended position when hook mechanisms 305 are in their latching position, and resiliently keep hook mechanisms 305 when they are in retracted, unlocked position.

When a user inadvertently tries to slam shut a door with outwardly extending hook sections 310 in a protruded state as in the locked position, i.e. the latter being out of elongated housing 102 through its open spaces 108*f*, outwardly extending hook sections 310*a* will be subjected to an impact (impact exceeding a preestablished magnitude) against an encountered external object, for example a strike plate S, specifically against zones between the apertures of the latter. To prevent an expected damage of outwardly extending hook sections 310, dual-hook locking assembly 10 designed according to the present invention is anti-slam protected. Thus, as the door moves toward closing, while outwardly extending hook sections 310*a* impact against an encountered external object, a continued closing movement of the door causes an inward movement of outwardly extending hook sections 310*a*. As a result, middle sections 310*b* of the pair of long external hook plates 310, which are components of hook mechanisms 305, press against and are stopped by their associated stop lugs 122. Upper stop lug 122 imparts a downward force to one hook mechanism 305 (the upper one), and/or lower stop lug 122 imparts an upward force to the other hook mechanism 305 (the lower one). Thus, while outwardly extending hook sections 310*a* retract into elongated housing 102, each hook mechanism 305 together with its associate pivoting body 205, without being damaged, are biased under the action of their corresponding helical tension spring 350 into their unlocked positions as illustrated in FIG. 1.

Anchor-cam wall 108*c* is engaged and supports at one side contacting lobes 310*d* of long external hook plates 310 of one hook mechanism 305 (the upper one) and at the other side is engaged and supports contacting lobes 310*d* of long external hook plates 310 of another hook mechanism 305 (the lower one). Due to the foregoing condition, a retractile movement of hook mechanism within casing subassembly 100 is achievable. The anchor-cam wall 108*c* fulfils the same role of engaging and support of contacting lobes 310*d* when a user starts changing the unlocked position into a locked position.

Two engaging lugs 124 serve as stops for limiting the movement of the hook mechanisms 305 and of interconnected with them segmental gears 205*e*, beyond an established position, during the unlocking operation.

As required, a detailed embodiment of the present invention is disclosed herein; however, it is to be understood that the disclosed embodiment is merely exemplary of the invention which may be embodied in various forms. Therefore, specific structural and functional details disclosed herein are not to be interpreted as limiting, but merely as a basis for the claims and as representative basis for teaching one skilled in the art to variously employ the present invention in virtually any appropriately detailed structure.

The invention claimed is:

1. A dual-hook lock comprising a casing, a pair of meshed gears rotatably supported within and by the casing, a pair of hooks contained within the casing, each hook being directly connected by only a pin to a respective one of the gears, and being movable by its respective gear between an extended unlocked position and a retracted locked position, and an adjustment mechanism for adjusting said locked and unlocked positions with respect to the casing, wherein the casing comprises an elongated housing and a closing plate, said elongated housing having a lateral main wall extending between a front wall and a back wall, and between a top wall and a bottom wall, said lateral main wall having two guiding openings, vertically spaced, said closing plate including a lateral base wall having two openings for guiding said hooks.

2. A dual-hook lock comprising a casing, a pair of meshed gears rotatably supported within and by the casing, a pair of hooks contained within the casing, each hook being directly connected by only a pin to a respective one of the gears, and being movable by its respective gear between an extended unlocked position and a retracted locked position, and an adjustment mechanism for adjusting said locked and unlocked positions with respect to the casing, wherein each of said gears comprises an upper pivoting body and a lower pivoting body, each said pivoting body being structurally formed as an unitary element incorporating a stepped cylindrical shaft having a median section, a front section and a back section, each of said front and back sections having a diameter less than that of said median section, said front and back sections being seated respectively in two guiding openings in said casing, a gear segment extending from said median section of said stepped cylindrical shaft, the respective gear segments interengaging so that rotation of one of the pivoting bodies causes a rotation of the other of said pivoting bodies, a tail element, situated adjacent to said gear segment and extending from said median section, and a cylindrical element projecting perpendicularly outward from an extremity of said tail element, said cylindrical element having a perpendicular opening.

3. The invention of claim 2, wherein each of said hook mechanisms comprises an outwardly extending hook section, a middle section and an inwardly connecting section having a hole formed therein, and further comprising a connecting pin inserted through said perpendicular opening of the cylindrical element projecting from the tail element, and through the hole formed in each hook mechanism, a resilient element connected between said pair of hook mechanisms via an anchor-cam wall coplanar with a transverse axis of symmetry defining basically said elongated housing, said anchor-cam wall being located perpendicularly to a central front wall of said elongated housing and a having an aperture, said resilient element being connected at one end to said anchor-cam wall via said aperture and its other end to at least one said hook mechanism so as to provide a return force from an extended position when said hook mechanisms are in their latching position.

4. A dual-hook lock comprising a casing, a pair of meshed gears rotatably supported within and by the casing, a pair of hooks contained within the casing, each hook being directly connected by only a pin to a respective one of the gears, and being movable by its respective gear between an extended unlocked position and a retracted locked position, and an adjustment mechanism for adjusting said locked and unlocked positions with respect to the casing, wherein said adjustment mechanism comprises two pairs of guiding plates, each pair of guiding plates having inwardly extending ends, which can turn around each of said pivoting bodies and interact with one of said hook mechanisms, and also having outwardly extending ends associated with an adjusting bolt-nut, whereby in said dual-hook locking assembly a direct pivotable linkage is established between said gearing means for operating and said means for locking, respectively, said pair of hook mechanisms.

5. A dual-hook locking assembly comprising in combination casing means for housing the following components of said dual-hook assembly;

means for locking including a pair of hook mechanisms positionally locatable between a locked position and an unlocked position, gearing means for operating said pair of hook mechanisms; and means for adjusting said pair of hook mechanisms with respect to a strike plate, said casing means including an elongated housing and a closing plate, said elongated housing incorporating a lateral main wall extending into a front and a back wall, and into a top and a bottom wall, said lateral main wall being provided with two guiding openings, vertically spaced;

said closing plate including a lateral base wall provided with two openings for guiding, coaxial and commensurate with said two guiding openings;

said gearing means for operating incorporating a pair of pivoting bodies, an upper and a lower one, each one of said pair of pivoting bodies being structurally formed as an unitary element incorporating a stepped cylindrical shaft having a median section and a front and a back section, both, the former and the latter, having a relatively lesser diameter than a median section diameter;

said front and back section engaging respectively said two guiding openings and said two openings for guiding; a segmental gear, extending from said median section of each said stepped cylindrical shaft and providing an inter engagement between said pair of pivoting bodies, so that a rotation of one pivoting body of said pair of pivoting bodies causes a rotation of another pivoting body of said pair of pivoting bodies;

a tail element, situated in a zone adjacent to each said segmental gear and extending from said median section being provided with a cylindrical element projecting perpendicularly out from an extremity of said tail element, said cylindrical element incorporating a perpendicular opening;

each of said pair of hook mechanisms, comprised in said means for locking, including an outwardly extending hook section, a middle section and an inwardly connecting section, the latter being provided with a hole; a connecting pin inserted through said perpendicular opening of said cylindrical element, included in said tail element, provided in each of said pivoting bodies and through said hole incorporated in each hook mechanism of said pair of hook mechanisms; at least one springy element for connecting said pair of hook mechanisms via an anchor-cam wall coplanar with a transverse axis of symmetry defining basically said elongated housing, said anchor-cam wall being located perpendicularly to a central front wall of said elongated housing and a having an aperture, said at least one springy element for connecting said pair of hook mechanisms being connected with one extremity to said anchor-cam wall via said aperture and with another extremity to at least one said hook mechanism of said pair of hook mechanisms, said at least one springy element developing a return force from an extended position when said hook mechanisms are in their latching position, and resiliently keeping said hook mechanisms in a convenient position with respect to said strike plate; and said means for adjusting said pair of hook mechanisms with respect to a strike plate comprising two pair of guiding plates, each pair of guiding plates having inwardly extending ends, via which is able to turn around each of said pivoting bodies and interact with one of said hook mechanisms, and also having outwardly extending ends associated with an adjusting bolt-nut, whereby in said dual-hook locking assembly a direct pivotable linkage is established between said gearing means for operating and said means for locking, respectively said pair of hook mechanisms.

* * * * *